United States Patent [19]

Rhodes et al.

[11] Patent Number: 5,066,390

[45] Date of Patent: Nov. 19, 1991

[54] MAGNETIC SEPARATOR WITH RECIPROCATING GRATE

[76] Inventors: Keith J. Rhodes, 8250 Ashare Ct., Clarkson, Mich. 48016; Scott D. Voorheis, 6611 Balmoral, Waterford, Mich. 48054

[21] Appl. No.: 532,963

[22] Filed: Jun. 4, 1990

[51] Int. Cl.[5] ..... B03C 1/26

[52] U.S. Cl. ..... 209/217; 209/229; 210/222

[58] Field of Search ..... 209/217, 213, 229, 228, 209/636, 38; 210/222, 223

[56] References Cited

U.S. PATENT DOCUMENTS

| | | | |
|---|---|---|---|
| 790,342 | 5/1905 | Campbell | 209/217 |
| 815,679 | 3/1906 | Campbell | 209/217 |
| 871,298 | 11/1907 | Schwarz | 209/217 |
| 986,389 | 3/1911 | Herr | 209/217 X |
| 2,822,089 | 2/1958 | Woodruff | 209/223 |
| 3,489,280 | 1/1970 | Israelson et al. | 209/223 |
| 4,031,011 | 6/1977 | Dorgathen | 210/222 |
| 4,251,372 | 2/1981 | Dolle | 210/222 |
| 4,394,264 | 7/1983 | Schimion et al. | 209/229 X |
| 4,457,838 | 7/1984 | Carr | 209/229 X |
| 4,750,996 | 6/1988 | Meister | 209/223.2 |
| 4,867,869 | 9/1989 | Barrett | 209/223.2 |

FOREIGN PATENT DOCUMENTS

| | | | |
|---|---|---|---|
| 39318 | 3/1984 | Japan | 210/222 |
| 433615 | 8/1935 | United Kingdom | 209/217 |
| 456155 | 11/1936 | United Kingdom | 209/217 |

OTHER PUBLICATIONS

Quick Clean Magnetic Drawer and Housings-200 Series Magnetic Products, Inc., brochure ©1988.

Self-Cleaning Drawer and Housing Magnets-200 Series Magnetic Products, Inc., brochure ©1988.

MP-433 Series Roto Grate Magnet, Magnetic Products, Inc. brochure, ©1989.

*Primary Examiner*—Donald T. Hajec

*Attorney, Agent, or Firm*—Basile and Hanlon

[57] ABSTRACT

A magnetic separator includes a plurality of elongated magnetic members generally disposed with longitudinal axes extending in parallel relationship with one another. A first end plate is connected to adjacent terminal ends of the magnetic members to hold the magnetic members with the longitudinal axes generally defining a common plane. Non-magnetic sheathing members are disposed sheathing the entire longitudinal length of the magnetic members. A second end plate is connected to adjacent terminal ends of the non-magnetic members to provide longitudinal sheathing and unsheathing movement of the sheathing members with respect to the magnetic members for cleaning accumulated magnetic particles from the exterior surface of the non-magnetic members. The first and second end plates are adapted for reciprocating movement in the commonm plane, preferably in a direction generally perpendicular to the longitudinal axes of the magnetic members to reduce bridging and clogging of the material flow. In a preferred embodiment, first and second sets of elongated members are arranged in first and second parallel planes. The longitudinal axes of the magnetic members are disposed generally partallel to one another and staggered with respect to one another in a direction of material flow generally perpendicular to the first and second planes. The first set of magnetic members are oscillated in a direction within the first plane opposite to the direction of oscillation of the second set of magnetic members within the second plane.

15 Claims, 3 Drawing Sheets

MAGNETIC SEPARATOR WITH RECIPROCATING GRATE

FIELD OF THE INVENTION

The invention relates to magnetic separation devices and, more particularly, to grate magnets.

BACKGROUND OF THE INVENTION

A conventional grate magnet includes a frame defining an opening through which material to be separated passes. A plurality of elongated, usually cylindrical magnets extend across the opening so that magnetic material is attracted to the magnets while non-magnetic material is not. Typically, the magnets are mounted in a drawer-like frame that is slidably housed in a delivery duct or chute so that the magnets can be removed from the duct before magnet material is removed from the magnets. A major draw back of the stationary magnetic drawers and housings is that many materials which would benefit from magnetic separation have flow characteristics which are incompatible with this type of separation structure, primarily because these difficult to flow materials are prone to bridge and clog the material passage and magnetic grate area through which the material is to flow. In an effort to overcome this difficulty, it is known to provide magnetic rotary grates which rotate about a longitudinal axis. However, difficulties are also encountered with the rotary type magnetic separators, in that the rotary type magnetic separators constantly rotate the magnetic bar with respect to the material flow leading to increased risk of washing off the previously captured magnetic particles from the magnetic bar. In the stationary drawer magnetic separators, magnetic particles are allowed to adhere to the bar and move to the lowermost edge of the bar where the particles are protected from direct impact with the material flow and continue to accumulate in a "bearding" manner. Bearding of magnetic particles is generally defined as the accumulation of magnetic particles at the lowermost edge of the bars which subsequently continue to accumulate creating a somewhat elongated sheet or "beard" along the longitudinal axis of the magnetic rod, or the sleeve enclosing the magnetic rod. While the rotary magnetic separators can prevent clogging of material flow through the separator portion of the material passage, the rotary magnetic separators accomplish this in a manner which reduces the efficiency of separating the magnetic material from the material flow. Attempts have been made to overcome these problems with the use of vibration, however the vibration devices cause problems such as weld cracking and other material failures. In addition, the vibration does not sufficiently reduce the risk of bridging and/or clogging in many material flow applications.

SUMMARY OF THE INVENTION

Therefore, it is desirable in the present invention to provide a magnetic grate type separator with improved anti-clogging material flow characteristics. It is also desirable in the present invention to accomplish increased anti-clogging material flow characteristics without reducing the efficiency of the separation of the magnetic particles from the material flow. The present invention accomplishes this by modifying the magnetic drawer and housing configuration previously used for magnetic grate separators. More specifically, each row of magnetic bars are separately supported by opposing end plates disposed at the terminal ends of the magnetic bars. The end plates are supported in connection with appropriate reciprocating means to move the end plates and associated magnetic bars in reciprocating movement along the plane defined by the longitudinal axis of the magnetic bars. Preferably, adjacent rows or planes of magnetic bars will be driven in opposite directions from one another during the reciprocating action. The opposing reciprocating action prevents clogging of the material flow passage, thereby eliminating flow problems that currently exist in approximately two-thirds of the applications which could benefit from the use of magnetic separation. The reciprocating movement can be configured to be horizontal, vertical, or in any plane between horizontal and vertical, although preferably the longitudinal axis of the material flow passage is in a vertical orientation with the plane of the magnetic bars being disposed normal to the material flow passage in a horizontal plane. The magnetic bars are staggered from row to row to improve magnetic filtration. In previously known stationary magnetic drawer separators, the material product would bridge between the magnetic bars or tubes causing flow problems with many types of materials. The present invention provides reciprocation of adjacent tiers of magnetic bars in opposite directions from tier to tier, thereby decreasing the risk of bridging between the magnetic bars for many types of material flows and overcoming the difficulties encountered with the rotary type magnetic separators and the stationary type drawer magnetic separators. The preferred embodiment of the present invention also provides a self cleaning configuration, in that pulling open a drawer-like mechanism simultaneously slides connected tubes from their sheathed position over the magnetic bars to an unsheathed position thereby removing the magnetic field maintaining the magnetic particles on the outer surface of the tubes providing a fast and simple method of removing the magnetic particles from the exterior of the tubes sheathing the magnetic bars.

Other objects and features of the invention will become apparent by reference to the following specification and to the drawings.

BRIEF DESCRIPTION OF THE DRAWINGS

The description herein makes reference to the accompanying drawings wherein like parts are referred to by like reference numerals throughout the various views, and wherein.

DESCRIPTION OF THE PREFERRED EMBODIMENTS

Figure 1:
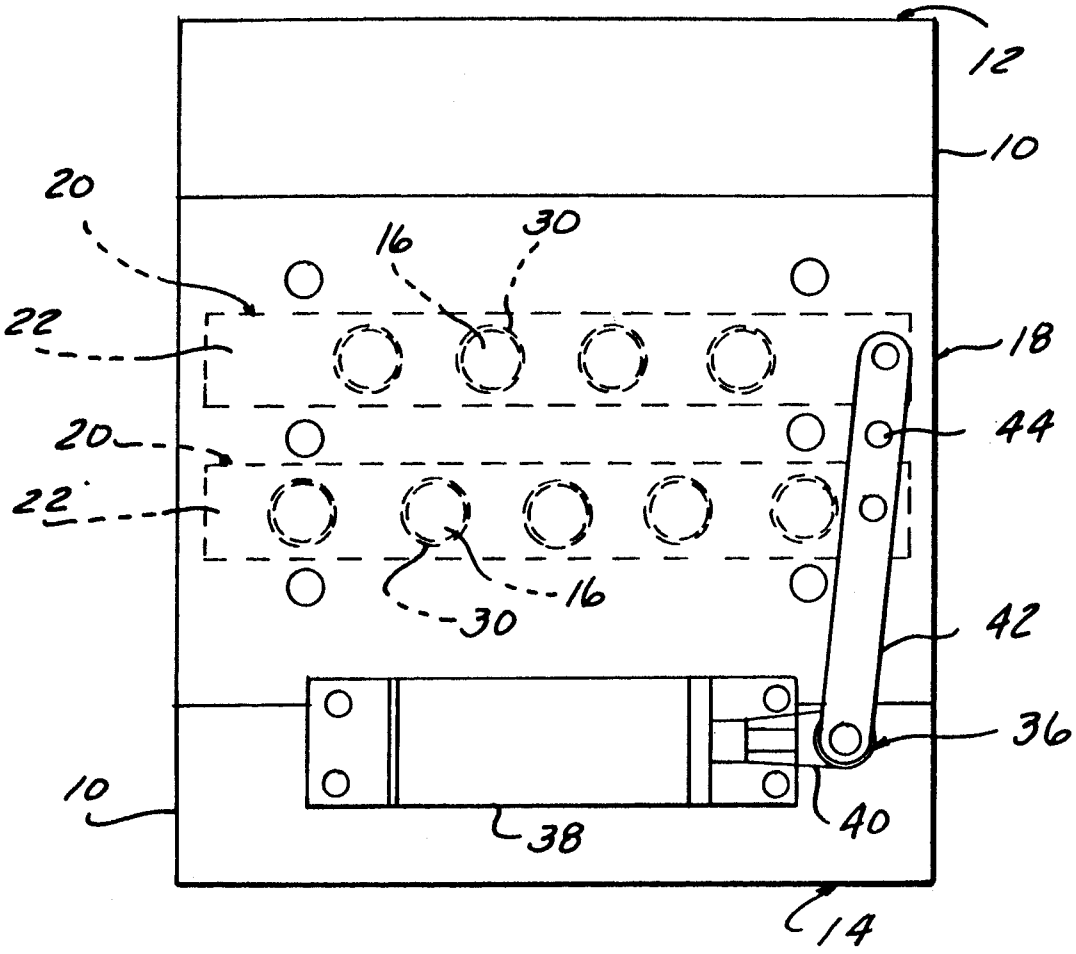
FIG. 1 is a rear view of a reciprocating magnetic grate separator according to the present invention showing reciprocating means for reciprocating a magnetic grate.
Figure 2:
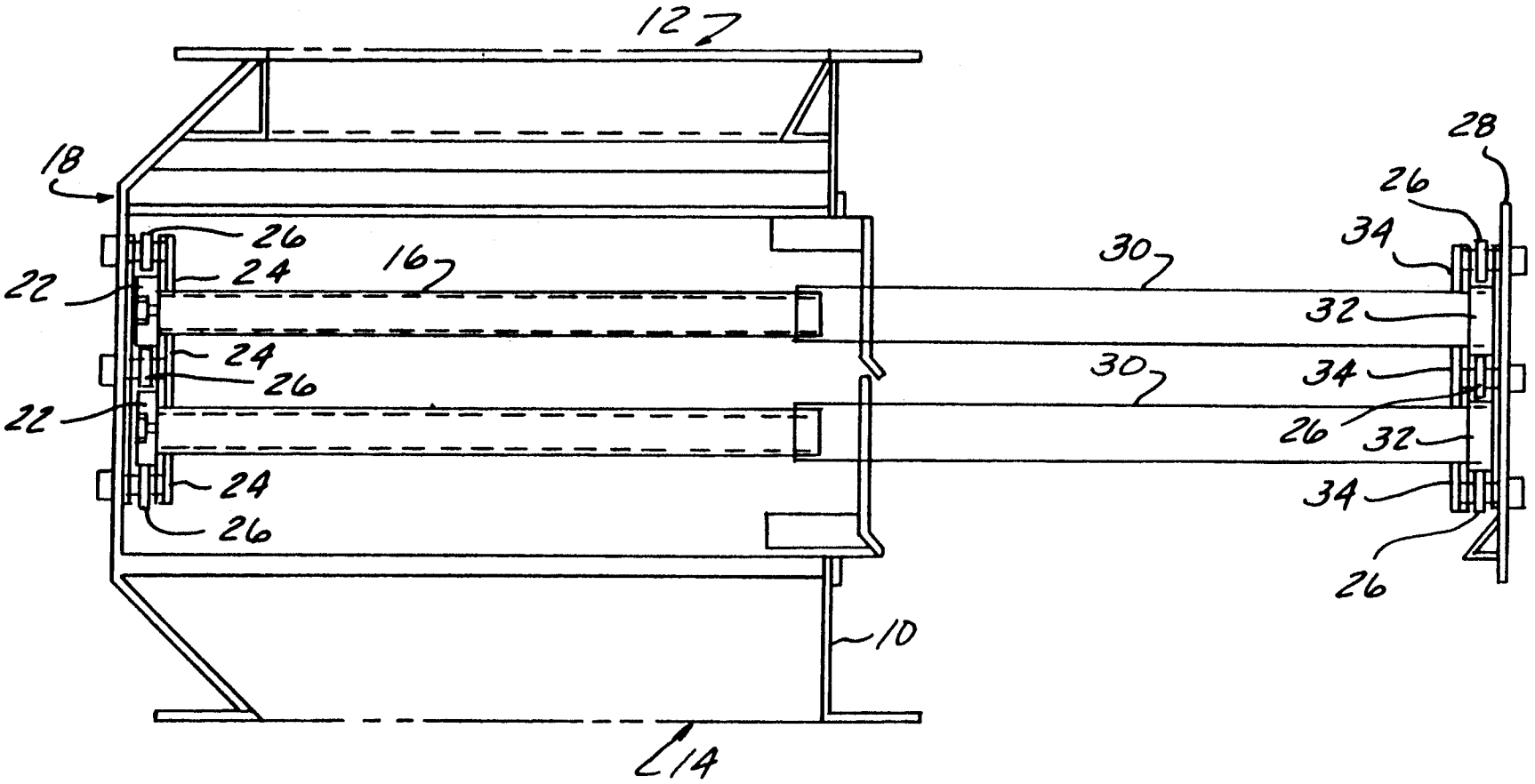
FIG. 2 is a side view of the reciprocating magnetic grate separator according to the present invention with a drawer in an open cleaning position for removing magnetic particles captured from the material flow.
Figure 4:
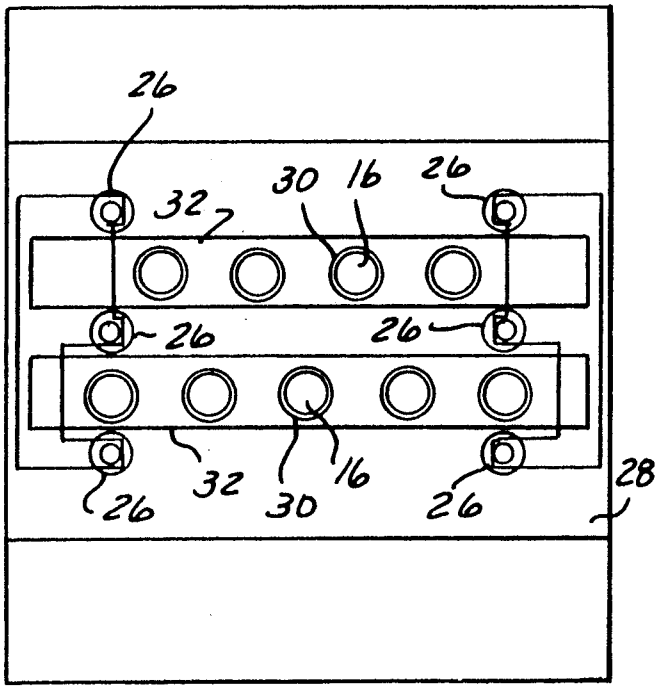
FIG. 4 is an end view of the reciprocating magnetic grate separator showing bearing means allowing planar reciprocation of the magnetic grate.
Figure 3:
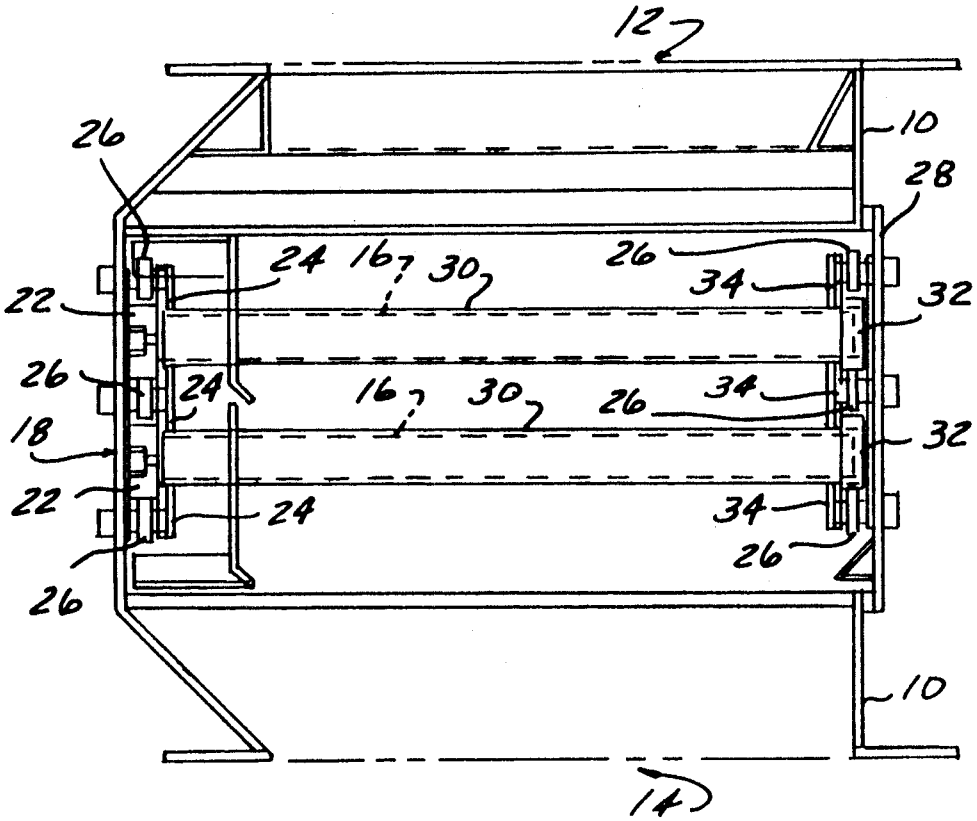
FIG. 3 is a side view of the reciprocating magnetic grate separator with the drawer in an operational position for removing magnetic particles from the material flow.

Drawer and housing magnets are designed to remove medium and small size ferrous tramp metal contaminants from dry, powder or granular free-flowing product streams in gravity-fed vertical chutes. Magnetic filtration ca be used to protect processing equipment such as milling, extruding and mixing machinery to insure high quality product standards. The reciprocating grates of the present invention can remove both large pieces of unwanted iron as well as minute ferrous particles from material flows that tend to clog and/or bridge when passed through small openings. The reciprocating action of the grate, and more particularly the opposing reciprocation of adjacent grates in the preferred embodiment, combs and breaks materials apart that tend to cling together to force all particles from the material stream to pass through the moving magnetic tubes. Preferably, the product stream flows through a vertical passage 10 having an upper inlet and a lower outlet 12 and 14 respectively. Rows of magnetic tubes or bars 16 are staggered with respect to one another to maximize magnetic filtration as the product flows through the housing 18. Tramp metal contaminants move to the underside of the magnetic tubes 16 where the tramp metal contaminants are protected from direct impact from the product stream flow thereby reducing tramp metal wash off. Each row of magnetic tube 16 is staggered to prevent bridging or choking of the product stream and to maximize magnetic filtration as product flows through the housing. Tramp metal contaminants are attracted to the magnetic tubes. The present invention can be used efficiently for separating tramp metal contaminants from many finely ground cohesive materials, such as: gypsum, barium carbonate, fuller's earth, lime, cohesive chemicals, confectionery sugar, cornstarch, flour, wood flour and fibrous materials like chopped hay, alfalfa, flax or the like. A reduction in product flow velocity occurs whenever an obstruction is introduced into the flow area. Depending on variable characteristics, changes in the flow rate will result. In order to maintain product flow, an increase in flow area between the magnetic tubes is required. Magnetic separation or filtration can also be used to remove metal particles from grain, coffee, peanuts and the like in a processing or handling step of such materials. Generally, the magnetic separator is placed within a product stream passage, chute, or the like, or part of a conveying system in such a manner that the grain or other material passes over and through the magnetic separator with entrained metal particles adhering to the separator and being deposited hereon.

The rows of magnetic cylinders 16 form a grate assembly 20. The grate assembly 20 includes a plurality of magnetic cylinders 16 fixedly secured at one end thereof to an end plate 22. The end plate 22 being held in position adjacent the side wall of housing 18 by means of seal plate 24. The end plate 22 is adapted for reciprocating movement in parallel relation to the adjacent side wall of the housing 18 by sealed roller bearing means 26 disposed at vertical positions above and below the end plate 22.

Adjacent the opposing side wall of housing 18 is an opening with a drawer-like cover member 28. Non-magnetic tubes slidably house or sheath the elongated magnetic cylinders 16, such that when the magnets are in the tubes 30, magnetic material is attracted to the exterior of the tubes 30, and when the tubes are pulled off from the magnetic cylinders 16, the magnetic material falls off from the exterior of the tubes. A second end plate 32 is connected to one longitudinal end of the non-magnetic tubes 30 at a position opposite from the end plate 22. The second end plate 32 is held adjacent to the interior surface of the cover member 28 by means of a second seal plate 34. The second end plate 32 is adapted for reciprocal movement in parallel relation to the cover member 28 by sealed roller bearing means 26 disposed on opposite sides of end plate 32.

Reciprocating means 36 is connected to the first end plate 22 for oscillating the grate defined by the first end plate 22, magnetic members 16, non-magnetic members 30 and second end plate 32. As depicted in FIG. 1, the reciprocating means 36 can include, but is not limited to, a reciprocating cylinder 38 having a driven rod 40 extending externally therefrom for connection to a lever 42. The lever 42 can be connected to first and second magnetic grates 20 with a pivot point 44 disposed between said first and second grates 20 to provide opposite reciprocating directions for the first and second grates when the cylinder 38 is actuated. For purposes of illustration, the cylinder 38 can operate at up to 120 cycles per minute to cause oscillation of the grate or grates through the lever for a minimum movement of one-quarter inch in either direction from a central position. Movement larger than one-quarter inch in either direction can be provided if desired or necessary for extremely difficult applications.

Preferably, the grate is oscillated within a common plane defined by the longitudinal axes of the magnetic members of the grate. Furthermore, it is preferred to oscillate the grate in a direction generally perpendicular to the longitudinal axes of the magnetic members. In addition, it is preferable to provide at least two grates spaced from one another along the path of material flow with the longitudinal axes of the magnetic members generally parallel to one another and staggered with respect to one another in the direction of material flow with the first grate being oscillated in one direction while the second grate is oscillated in the opposite direction.

While the invention has been described in connection with what is considered to be the most practical and preferred embodiments, it is to be understood that the invention is not limited to the disclosed embodiments but, on the contrary, is intended to cover various modifications and equivalent arrangements included within the spirit and scope of the appended claims, which scope is to be accorded the broadest interpretation permissible under the law to encompass all such modifications and equivalent structures.

What is claimed is:

1. A magnetic separator comprising:

a plurality of elongated magnetic members including least one group of said elongated magnetic members having longitudinal axes lying in at least one common plane with first and second terminal ends;

first end plate means connected to said first terminal end of each of said plurality of elongated magnetic members, said first end plate means adapted for reciprocation in said common plane;

non-magnetic means for sheathing each of said plurality of elongated magnetic members, said non-magnetic means having first terminal ends adjacent said first terminal ends of said elongated magnetic members and second terminal ends adjacent said second terminal ends of said elongated magnetic members, said non-magnetic means adapted for sheathing and unsheathing movement longitudinally along each of said elongated magnetic members;

second end plate means connected to said second terminal ends of each of said non-magnetic means, said second end plate means adapted for reciprocation in said common plane; and reciprocating means connected to at least one of said first and second end plate means for oscillating a grate assembly defined by said first end plate means and said connected elongated magnetic members and said second end plate means and said connected non-magnetic means, when said non-magnetic means are in a sheathing position over said elongated magnetic members.

2. The magnetic separator of claim 1 wherein said elongated magnetic members have longitudinal axes disposed generally parallel to one another and said reciprocating means oscillates said grate in said common plane in direction normal to said longitudinal axes of said elongated magnetic members.

3. The magnetic separator of claim 1 further comprising housing means defining a material flow passage having an inlet and an outlet, said housing means for enclosing said grate between said inlet and outlet such that material flowing within said passage is forced to flow through said oscillating grate.

4. The magnetic separator of claim 3 further comprising said housing having an aperture in a sidewall thereof and a cover member for closing said aperture, wherein said grate is disposed within said housing means such that said second end plate means is connected to said cover member so that removal of said cover member imparts an unsheathing movement to said non-magnetic means for cleaning magnetic particles from said non-magnetic means.

5. The magnetic separator of claim 1 wherein said plurality of magnetic members further includes a second group of elongated magnetic members having longitudinal axes defining a second common plane, wherein said reciprocating means oscillates said first and second groups of elongated magnetic members in opposite directions with respect to one another within said first and second planes respectively.

6. The magnetic separator of claim 5 wherein said longitudinal axis of said first and second groups of elongated magnetic members are generally parallel to one another and staggered with respect to one another in a direction normal to said first and second common planes.

7. The magnetic separator of claim 6 wherein said reciprocating means further comprises a fluid operated actuator connected to a lever having a pivot point disposed between said first and second common planes and connections to said first end plate means connected to said first and second groups of elongated magnetic members respectively.

8. The magnetic separator of claim 1 further comprising sealed bearing means disposed on opposing sides of said first and second end plate means for restraining said oscillating motion to said common plane.

9. A magnetic separator comprising:

a plurality of elongated magnetic members including at least first and second groups of said elongated magnetic members having generally parallel longitudinal axes lying in at least first and second generally parallel planes with first and second terminal ends, said first and second groups of elongated members staggered with respect to one another in a direction generally normal to said first and second parallel planes;

a first end plate connected to said first terminal end of each of said first group of elongated magnetic members, said first end plate adapted for reciprocation in said first plane in a direction generally normal to said longitudinal axes of said first group of elongated magnetic members;

first non-magnetic means for sheathing each of said first group of elongated magnetic members, said first non-magnetic means having first terminal ends adjacent said first terminal ends of said elongated magnetic members and second terminal ends adjacent said second terminal ends of said elongated magnetic members, said first non-magnetic means adapted for sheathing and unsheathing movement longitudinally along each of said elongated magnetic members;

a second end plate connected to said second terminal ends of each of said first non-magnetic means sheathing said first group of elongated magnetic members, said second end plate adapted for reciprocation in said first plane in a direction generally normal to the longitudinal axes of said elongated magnetic members;

a third end plate connected to said first terminal end of each of said second group of elongated magnetic members, said third end plate adapted for reciprocation in said second plane in a direction generally normal to said longitudinal axes of said second group of elongated magnetic members;

second non-magnetic means for sheathing each of said second group of elongated magnetic members, said second non-magnetic means having first terminal ends adjacent said first terminal ends of said elongated magnetic members and second terminal ends adjacent said second terminal ends of said elongated magnetic members, said second non-magnetic means adapted for sheathing and unsheathing movement longitudinally along each of said elongated magnetic members;

a fourth end plate connected to said second terminal ends of each of said second non-magnetic means sheathing said second group of elongated magnetic members, said fourth end plate adapted for reciprocation in said second plane in a direction generally normal to the longitudinal axes of said elongated magnetic members; and reciprocating means connected to said first and third end plates for oscillating said first and second groups of elongated magnetic members in opposite directions with respect to one another while sheathed by said first and second non-magnetic means.

10. The magnetic separator of claim 9 further comprising housing means defining a material flow passage having an inlet and an outlet, said housing means for enclosing said first and second groups of elongated magnetic members between said inlet and outlet such that material flowing within said passage is forced to flow through said oscillating magnetic members in a direction generally perpendicular to said first and second planes.

11. The magnetic separator of claim 10 further comprising said housing having an aperture in a sidewall thereof and a cover member for closing said aperture, wherein said first and second groups of elongated magnetic members are disposed within said housing means such that said second and fourth end plates are connected to said cover member so that removal of said cover member imparts an unsheathing movement to said first and second non-magnetic means for cleaning magnetic particles from said first and second non-magnetic means.

12. The magnetic separator of claim 11 wherein said reciprocating means further comprises a fluid operated actuator connected to a lever having a pivot point disposed between said first and second common planes and connections to said first and second end plates connected to said first and second groups of elongated magnetic members respectively.

13. A method for separating magnetic particles from a flow of material comprising the steps of:

passing the material flow through a passage with a magnetic separator having a first magnetic grate disposed within said passage and exposed to said material flow;

oscillator said first magnetic grate as said material flow passes through said first magnetic grate to reduce bridging and clogging of material flow;

passing said material flow through a second magnetic grate disposed slightly downstream of said first magnetic grate; and oscillating said second magnetic grate in a direction opposing the oscillation of the first magnetic grate to further reduce bridging and clogging of the material flow.

14. The method of claim 13 wherein said first magnetic grate is disposed in a plane generally perpendicular to the material flow and is oscillated within the perpendicular plane.

15. The method of claim 13 wherein said second magnetic grate is disposed in a plane generally perpendicular to the direction of material flow and is oscillated in said perpendicular plane.

* * * * *